US008933286B2

(12) United States Patent
Souza et al.

(10) Patent No.: US 8,933,286 B2
(45) Date of Patent: Jan. 13, 2015

(54) CATALYTIC CRACKING PROCESS OF A STREAM OF HYDROCARBONS FOR MAXIMIZATION OF LIGHT OLEFINS

(75) Inventors: Aline Barbosa Junqueira de Souza, Rio de Janeiro (BR); Marcelo Maciel Pereira, Rio de Janeiro (BR); Lam Yiu Lau, Rio de Janeiro (BR); Janaina Gorne, Rio de Janeiro (BR); Andrea de Rezende Pinho, Rio de Janeiro (BR)

(73) Assignee: Petroleo Brasileiro S.A.—Petrobras, Rio de Janeiro (BR)

( * ) Notice: Subject to any disclaimer, the term of this patent is extended or adjusted under 35 U.S.C. 154(b) by 119 days.

(21) Appl. No.: 13/058,813

(22) PCT Filed: Nov. 23, 2009

(86) PCT No.: PCT/GB2009/002740

§ 371 (c)(1),
(2), (4) Date: Jul. 21, 2011

(87) PCT Pub. No.: WO2010/061179

PCT Pub. Date: Jun. 3, 2010

(65) Prior Publication Data

US 2011/0270009 A1 Nov. 3, 2011

(30) Foreign Application Priority Data

Nov. 25, 2008 (BR) ..... 0805207

(51) Int. Cl.

| | |
|---|---|
| ***C07C 4/02*** | (2006.01) |
| ***C07C 4/06*** | (2006.01) |
| ***C10G 11/05*** | (2006.01) |
| *B01J 29/04* | (2006.01) |
| *B01J 29/42* | (2006.01) |

(52) U.S. Cl.

CPC ..... *C10G 11/05* (2013.01); *C10G 2400/20* (2013.01); *C10G 2300/4006* (2013.01); *C10G 2300/4012* (2013.01)

USPC ..... 585/653; 585/651; 208/118; 208/119; 208/120.01

(58) Field of Classification Search

USPC ..... 585/653

See application file for complete search history.

(56) References Cited

U.S. PATENT DOCUMENTS

| | | | | |
|---|---|---|---|---|
| 5,043,522 | A * | 8/1991 | Leyshon et al. | 585/651 |
| 5,298,150 | A * | 3/1994 | Fletcher et al. | 208/89 |
| 2006/0058562 | A1 * | 3/2006 | Choi et al. | 585/651 |

FOREIGN PATENT DOCUMENTS

| | | | |
|---|---|---|---|
| EP | 0 903 178 | A1 | 3/1999 |
| EP | 1 867 388 | A1 | 12/2007 |
| EP | 1867388 | A1 * | 12/2007 |
| EP | 1 935 865 | A1 | 6/2008 |
| GB | 1 469 345 | A | 4/1977 |
| WO | 01/04237 | A2 | 1/2001 |

* cited by examiner

*Primary Examiner* — In Suk Bullock
*Assistant Examiner* — Youngsul Jeong
(74) *Attorney, Agent, or Firm* — Sughrue Mion, PLLC

(57) ABSTRACT

A process is described for maximization of light olefins, preferably ethylene, by the catalytic cracking of feeds of saturated hydrocarbons, with molecular size in the range from 4 to 6 carbon atoms. The process uses a catalyst based on a zeolite of type ZSM-5 with low sodium content and modified with nickel, with concentration by weight of nickel, expressed in the form of oxide, in the range from 0.1% to 20% relative to the weight of zeolite in the catalyst, and operating conditions that involve a temperature between 400° C. and 650° C. and feed partial pressure between 0.1 and 1.0 MPa, so that the product recovered is rich in light olefins, with ethylene/propylene ratio in the range from 0.25 to 2.00.

11 Claims, No Drawings

CATALYTIC CRACKING PROCESS OF A STREAM OF HYDROCARBONS FOR MAXIMIZATION OF LIGHT OLEFINS

CROSS REFERENCE TO RELATED APPLICATIONS

This application is a National Stage of International Application No. PCT/GB2009/002740 filed Nov. 23, 2009, claiming priority based on Brazilian Patent Application Patent Application No. PI 0805207-7 filed Nov. 25, 2008, the contents of all of which are incorporated herein by reference in their entirety.

FIELD OF THE INVENTION

The present invention relates to the field of processes of catalytic cracking for maximization of the production of light olefins, preferably ethylene, using saturated hydrocarbons, primarily in the range from C4 to C6, as feeds. More specifically, the catalytic cracking process increases the selectivity for light olefins by using a zeolite catalyst modified with nickel.

BACKGROUND OF THE INVENTION

The global market for light olefins is changing dramatically, both with respect to capacity and with respect to demand. It is estimated that demand in this market will increase by 5% per year until 2010, which requires an increase in production capacity of 5.4% per year in the same period.

At present the two main routes of production of light olefins, such as ethylene and propylene, are pyrolysis (steam cracker) and fluid catalytic cracking (FCC), using conventional units. However, these processes are not meeting the present increase in demand, largely owing to the low yields obtained. Typically, in conventional FCC, the yields for ethylene and propylene obtained are around 0.8% and 5% by weight, respectively. Now, in the pyrolysis process, the yield of ethylene is highly dependent on the feed used, for example if the feed used is ethane, the expected yield is about 70%, but if the feed is light naphtha, the yield drops to somewhere around 30% by weight.

One of the means usually employed for improving the selectivity for light olefins in processes of catalytic cracking, especially FCC, is to change the composition of the feeds processed. It is known that with increase in the size of the carbon chain of olefins and paraffins, their reactivity also increases, and moreover, it is known that olefins are more reactive than paraffins.

U.S. Pat. Nos. 7,375,257 and 6,977,321 describe the production of light olefins by selective cracking of a feed comprising olefins with four or more carbon atoms using zeolites of type MFI as active ingredient of the catalyst.

A process for catalytic cracking of two streams, a main stream rich in paraffins and an additional stream rich in olefins, employing high temperature (500° C. to 700° C.) and low pressure (1 to 30 psia) and a catalyst based on zeolite MFI, has already been described in U.S. Pat. No. 5,043,522. The olefin-rich additional stream is used for compensating the lower reactivity of the paraffin-rich main stream.

Another means of promoting improvement in selectivity for light olefins is modification of the catalysts used in processes of catalytic cracking.

The specialist literature contains various examples of modifications of zeolites that are selective for light olefins, such as ZSM-5, for improving activity, selectivity and stability in FCC processes, such as the patent documents cited below.

U.S. Pat. No. 4,976,847 teaches the use of Pt, Pd, Ni, Co, Fe, W, Mo and mixtures thereof or silicates of Ga, Fe, Sc, Rh and Cr deposited on zeolite ZSM-5, in FCC processes, for maximizing the yield of light olefins.

U.S. Pat. No. 6,153,089 already describes the use of Pt, Pd, W, Mo, Re and mixtures thereof for modifying zeolite ZSM-5, applied to FCC of hydrocarbon feeds, with the aim of producing light olefins and aromatic hydrocarbons.

Documents WO2005094492, WO200669535 and EP 0901688392, describe the use of transition metals, such as Fe, Co, Ni for the modification of zeolite ZSM-5, for direct use or in conjunction with conventional FCC catalysts, so that the resultant catalytic system increases the yield of light olefins in FCC processes for petrochemical raw material—PFCC. These documents deal almost exclusively with the use of iron in the modification of zeolites, as well as the use of feeds that are much more reactive than saturated hydrocarbons of low molecular weight. Furthermore, the modifications carried out on zeolite ZSM-5 are not capable of altering the ethylene/propylene ratio, in terms of selectivity.

Patent application US 2006/0116544 A1 describes the use of Mn or Zr in combination with rare earths and phosphates in type ZSM-5 zeolites. This combination promotes better retention of active sites at high temperature and in the presence of steam. The stability of this catalytic system in pyrolysis processes proved to be superior to that of the processes already known. However, there is no indication regarding selectivity with respect to production of olefins.

U.S. Pat. No. 6,888,038 relates to a method for obtaining olefins by the catalytic cracking of feeds of C4-05 hydrocarbons using a zeolite as catalyst, more specifically a type MTT zeolite, and to the co-processing of a stream comprising an oxygenated hydrocarbon.

Although the use of feeds that are more reactive and modification of the catalysts employed in processes of catalytic cracking have been able to provide a significant increase in selectivity for light olefins, the processes used at present still employ severe operating conditions, especially with regard to the temperatures applied.

For example, in the case of petrochemical fluid catalytic cracking (PFCC), which uses a catalytic system based on zeolites of type ZSM-5, for maximizing propylene, temperatures are applied in the range from 560° C. to 590° C., and cracking of the light hydrocarbons generated (C4-05 olefins) only begins above 600° C., with a consequent increase in the production of ethylene.

In a recent publication, Jiangyin Lu et al. show that a small amount of chromium deposited on zeolite ZSM-5 improves the conversion of isobutane to ethylene and propylene in catalytic cracking processes. However, the operating conditions used are severe, employing temperatures above 600° C. (Catalysis Letters, Vol. 109 (2006) 65-70, "Cr-HZSM-5 zeolites—Highly efficient catalytic cracking of iso-butane to produce light olefins").

To summarize, a catalytic cracking process that uses a highly active catalyst for cracking reactions of saturated hydrocarbons of low molecular weight and provides, at the same time, greater selectivity for ethylene, in milder reaction conditions, is still unknown.

SUMMARY OF THE INVENTION

In a broad sense, the present invention relates to a catalytic cracking process that employs a catalyst based on zeolite of type ZSM-5 modified with nickel, so as to maximize the production of light olefins, principally ethylene.

The catalyst employed, a modified zeolite ZSM-5, displays greater activity than the corresponding unmodified zeolite, and greater selectivity for ethylene, which makes it possible to use milder operating conditions than the conventional processes of catalytic cracking.

The process can be carried out by contact of the feed with the catalyst of a format with morphology compatible with the type of process, either in a fixed bed or in a fluidized bed.

The process permits, moreover, the use of feeds of C4-C6 saturated hydrocarbons, less reactive than the feeds rich in olefins, used in known processes for the production of light olefins.

DETAILED DESCRIPTION OF THE INVENTION

The present invention relates to a process for maximizing light olefins, propylene and principally ethylene, by the catalytic cracking of feeds of saturated hydrocarbons, using as catalyst a zeolite of type ZSM-5 modified with nickel, under milder operating conditions compared with a conventional process.

According to the process, the feed of saturated hydrocarbons is brought in contact with a catalyst, a zeolite of type ZSM-5 modified with nickel, under conditions that involve partial pressure of the feed between 0.1 and 1.0 MPa, supplemented at atmospheric pressure with an inert gas, such as nitrogen, contact time with the catalyst between 0.01 and 0.5 seconds, catalyst/feed ratio less than 2, and temperatures between 400° C. and 600° C., preferably between 450° C. and 600° C., more preferably between 500° C. and 600° C., recovering a product enriched in light olefins where the ethylene/propylene ratio is in the range from 0.25 to 2.00. The unreacted feed can be recycled to the reactor, and the production of the desired products can thus continue.

The process can be carried out by passing the feed through a fluidized bed of catalysts as in the case of conventional FCC, or through a fixed bed.

The feeds that can be used for said process are saturated hydrocarbons, with molecular size in the range from 4 to 6 carbon atoms.

In conventional FCC units, the contact time with the catalyst is preferably between 0.5 and 5 seconds for a catalyst/oil ratio between 0.5 and 15.

In this process, the catalyst/feed contact time is from 0.01 to 0.5 seconds. This shorter contact time minimizes the reactions of thermal cracking. Undesirable side reactions such as hydrogen transfer, which are responsible for the consumption of olefins, are virtually eliminated. In this way the final yield of light olefins obtained is increased.

In the processes of fluid catalytic cracking there is generally a decrease in conversion owing to the short contact time. To compensate for this decrease, the FCC processes for petrochemical raw materials (PFCC) usually operate at a high catalyst/oil ratio, around 15-25, which appears to favour catalytic cracking to the detriment of thermal cracking. However, the use of high catalyst/oil ratios has its disadvantages, such as the loss of catalyst by attrition.

The catalyst employed is a zeolite of type ZSM-5, modified with nickel, used in its acid form, i.e. with sodium content less than 0.05 wt. %.

A suitable amount of nickel deposited on a zeolite ZSM-5 results in a catalyst that is highly active and selective for cracking reactions of C4-C6 hydrocarbons to obtain C2-C3 olefins, as demonstrated by comparing the zeolite modified with nickel with the unmodified zeolite ZSM-5, taken as reference for the examples presented in Table 1 of Example 1. In this comparison, it can be seen that there was an increase in activity of the zeolite modified with nickel and that the selectivity for ethylene, represented by the ethylene/propylene ratio, was significantly greater than that presented by unmodified ZSM-5.

The greater selectivity for ethylene of the modified ZSM-5 can be explained by the presence of nickel in elemental form, the action of which would be to promote the formation of more-reactive unsaturated hydrocarbons, favouring the production of light olefins.

In this case, the content of nickel recommended for deposition on zeolite ZSM-5, expressed in the form of oxide (NiO), must be between 0.1% and 20%, preferably between 0.3% and 15%, and more preferably between 0.5% and 7 wt. %.

The content of nickel deposited on the zeolite is controlled so as to ensure maximum activity without adversely affecting the desired $C2^{=}/C3^{=}$ selectivity, which is obtained by employing the range recommended above, having observed:

Decrease in catalytic activity, for nickel contents near the upper limit of the recommended range, possibly due to blocking of the acid sites of the zeolite by the nickel.

Increase in selectivity for light olefins with increase in the nickel content, probably due to the larger number of metallic sites present in the catalyst.

The nickel can be deposited by any of the known methods, including methods of impregnation or of ion exchange. Usually a nickel salt is deposited on the zeolite, followed by calcination for transforming the precursor salt to nickel oxide.

Accordingly, the conditions of the process for maximization of olefins, with greater selectivity for ethylene/propylene, are milder compared with those used in conventional catalytic cracking units, as illustrated by the following examples.

EXAMPLES

The laboratory-scale experiments were performed in a unit for catalytic assessment of tubular multi-reactors, in a fixed bed, using catalysts of zeolite ZSM-5 modified with nickel with different concentrations of nickel oxide prepared by the ion exchange method and by the impregnation method.

The catalyst was dried beforehand under a stream of 30 ml/min of nitrogen, at a temperature of 500° C., for 1 hour, and the activity was determined after 30 minutes of cracking reaction.

The products that formed in the cracking reactions were analysed on line, by gas chromatography, determining the selectivity of the reaction after 30 minutes of contact of the feed with the catalyst, said time being sufficient for the activity to reach the steady state. The selectivities $C2^{=}$ and $C3^{=}$ were determined as the fraction of hydrocarbon converted to ethylene and to propylene, respectively.

Example 1

This example illustrates the maximization with respect to olefins and C2/C3 selectivity of zeolite ZSM-5, modified and unmodified, used in the catalytic cracking of a feed of i-C4.

A mixture of 10% of i-C4 in nitrogen was fed into the reactor at a temperature of 550° C. and flow rate of 30 ml/min.

Table 1 shows the results of the tests corresponding to the performance of the unmodified zeolite ZSM-5, taken as reference (R), in comparison with zeolite ZSM-5 modified with nickel, prepared both by impregnation (B and D), and by ion exchange (A and C), demonstrating an increase in $C2^{=}/C3^{=}$ selectivity of the zeolite ZSM-5 modified with nickel (A, B, C and D) relative to the reference (R). The selectivity was calculated for conversion of 10% of the feed i-C4.

TABLE 1

| Catalyst | % Ni | Activity µmol/g · min | Selectivity C2= | C3= | C2=/C3= |
|---|---|---|---|---|---|
| R | — | 46 | 0.03 | 0.43 | 0.06 |
| A | 0.4 | 700 | 0.16 | 0.35 | 0.46 |
| B | 1.0 | 600 | 0.20 | 0.32 | 0.63 |
| C | 4.0 | 450 | 0.19 | 0.28 | 0.68 |
| D | 7.0 | 400 | 0.20 | 0.16 | 1.25 |

The results demonstrate the advantages of the process of catalytic cracking using the zeolite modified with nickel, since it maximizes ethylene, under milder operating conditions than usual, as well as increasing the $C2^{=}/C3^{=}$ selectivity, regardless of the method used for deposition of nickel on the zeolite.

Example 2

This example illustrates the increase in activity of the type ZSM-5 zeolite modified with nickel for maximizing olefins and $C2^{=}/C3^{=}$ selectivity for the reaction of catalytic cracking of n-C6.

A mixture of 17.7% of n-hexane in nitrogen was fed into the reactor at a temperature of 500° C. and flow rate of 30 ml/min.

Table 2 shows the performance of the sample (B) of ZSM-5 modified with nickel by the ion exchange method, relative to the reference sample (R) of unmodified zeolite ZSM-5.

TABLE 2

| Catalyst | % Ni | Activity | Selectivity C2= | C3= | C2=/C3= |
|---|---|---|---|---|---|
| R | 0 | 2.65 | 0.11 | 0.28 | 0.38 |
| A | 0.4 | 2.80 | 0.16 | 0.28 | 0.55 |

In this case it can be seen that the deposition of nickel on the ZSM-5 improves the activity of the catalyst for increasing the concentration of olefins, observing an increase in $C2^{=}/C3^{=}$ selectivity.

Example 3

This example of the process uses i-C4 as feed, with increase in conversion by the application of a larger amount of catalyst.

A mixture of 10% of i-C4 and nitrogen was fed into the reactor at a temperature of 550° C. and flow rate of 30 ml/min. In each run, the same weight of 0.105 g of catalyst was used, taking the catalyst density as 2 g/ml and contact time approximately 0.25 s.

The activities and selectivities of the catalysts remain stable starting from 15 minutes up to a minimum of 42 minutes.

Catalysts B and C, already described in Example 1, and catalyst E, with low Ni content (ten times less than B), were tested.

Table 3 shows the results of the tests. It can be seen that:

catalysts B and C are more active (greater conversion to olefins) than catalyst E with only 0.1% Ni;

all the examples show ethylene/propylene selectivity ratio greater than 0.5;

catalyst B reached 65% conversion, high yield of ethylene (15.4% w/w) and propylene (17.7% w/w).

TABLE 3

| CATALYST | E | C | B |
|---|---|---|---|
| % Ni | 0.1 | 4 | 1 |
| Conversion % | 22 | 33 | 65 |
| Yield, % w/w | | | |
| Methane | 3.34 | 7.37 | 16.20 |
| Ethane | 0 | 0 | 0.00 |
| Ethylene | 3.53 | 9.84 | 15.40 |
| Propane | 1.78 | 1.62 | 0.98 |
| Propylene | 6.89 | 9.71 | 17.70 |
| n-Butane | 0.29 | 0.34 | 0.17 |
| Butylenes | 3.55 | 3.81 | 6.28 |
| C5+ | 0.92 | 0.4 | 8.22 |
| Selectivity | | | |
| C2= | 0.16 | 0.30 | 0.24 |
| C3= | 0.31 | 0.29 | 0.27 |
| C2=/C3= | 0.51 | 1.01 | 0.87 |

The invention claimed is:

1. Process for catalytic cracking of hydrocarbons for production of light olefins, characterized in that it comprises contacting a feed comprising saturated hydrocarbons, with molecular size in the range from 4 to 6 carbon atoms, and a catalyst comprising a zeolite of type ZSM-5 modified with nickel, having a concentration by weight of nickel, expressed in the form of oxide, of from 0.4% to 1.0% relative to the weight of zeolites, under conditions for cracking at a temperature from 400° C. to 600° C., feed partial pressure from 0.1 to 1.0 MPa, and contact time from 0.01 to 0.5 seconds, catalyst/feed ratio less than 2.0, recovering a product enriched in olefins, with degree of selectivity $C2^{=}/C3^{=}$ from 0.25 to 2.00.

2. Process according to claim 1, characterized in that the zeolite contains sodium at a content below 0.05 wt. % relative to the weight of zeolites.

3. Process according to claim 1, characterized in that the zeolite is modified with nickel by impregnation, followed by calcination.

4. Process according to claim 1, characterized in that the zeolite is modified with nickel by ion exchange, followed by calcination.

5. Process according to claim 1, characterized in that the cracking temperature is from 450 to 600° C.

6. Process according to claim 5, characterized in that the cracking temperature is from 500° C. to 600° C.

7. Process according to claim 1, characterized in that the feed partial pressure is from 0.1 to 0.6 Mpa.

8. Process according to claim 7, characterized in that the feed partial pressure is from 0.1 to 0.3 Mpa.

9. Process according to claim 1, characterized in that one or more of C2, C3 and C4 olefins are produced.

10. Process according to claim 9, characterized in that one or more of C2 and C3 olefins are produced.

11. Process of catalytic cracking of a stream of hydrocarbons for maximization of light olefins, characterized in that it comprises the contact of a feed constituted of a mixture of saturated hydrocarbons, with molecular size in the range from 4 to 6 carbon atoms, and a catalyst based on zeolites of type ZSM5 modified with nickel, with concentration by weight of nickel, expressed in the form of oxide, between 0.4% and 1.0% relative to the weight of zeolites, in conditions for cracking at a temperature between 400° C. and 600° C., feed partial pressure between 0.1 and 1.0 MPa, and contact time between 0.01 and 0.5 seconds, catalyst/feed ratio less than 2.0, recovering a product enriched in light olefins with degree of selectivity $C2^{=}/C3^{=}$ between 0.25 and 2.00.

* * * * *